United States Patent [19]

Grantham

[11] 4,059,257

[45] Nov. 22, 1977

[54] LAUNDRY FOLDER

[76] Inventor: Frederick W. Grantham, 152 W. Pico Blvd., Los Angeles, Calif. 90015

[21] Appl. No.: 615,925

[22] Filed: Sept. 23, 1975

Related U.S. Application Data

[62] Division of Ser. No. 47,188, June 18, 1970, Pat. No. 3,920,237.

[51] Int. Cl.[2] ..... B65H 45/22

[52] U.S. Cl. ..... 270/66; 270/82; 270/85

[58] Field of Search ..... 270/61 R, 66, 67, 82, 270/85; 38/143; 271/227, 250; 226/20; 214/6 H

[56] References Cited

U.S. PATENT DOCUMENTS

| | | | |
|---|---|---|---|
| 3,462,138 | 8/1969 | Grantham | 270/67 |
| 3,463,482 | 8/1969 | Baron | 38/143 X |
| 3,467,370 | 9/1969 | Grantham | 270/67 |
| 3,477,708 | 11/1969 | Henry | 270/69 |

*Primary Examiner*—Edgar S. Burr
*Assistant Examiner*—A. Heinz
*Attorney, Agent, or Firm*—Henry M. Bissell

[57] ABSTRACT

A laundry folder for folding small pieces, having means for automatically centering the pieces transversely relative to a longitudinal center line and maintaining them so centered in their travel through the folder, including photo-electric cells for spotting the pieces and centering them, the centering means including transversely shiftable belt means and the photo-electric cells controlling the means for shifting the belt means; means for compensating for stretchability of laundry pieces such as knit shorts, so as to fold them in true straight line formation despite deformation as would otherwise be caused by the stretchability of the pieces; a wicket for placing the folded pieces on a supporting surface and means for lowering the supporting surface as the pieces are placed thereon in a stack, so that as the stack is formed, the top piece of the stack is always at substantially the same height.

16 Claims, 13 Drawing Figures

Fig. 10.
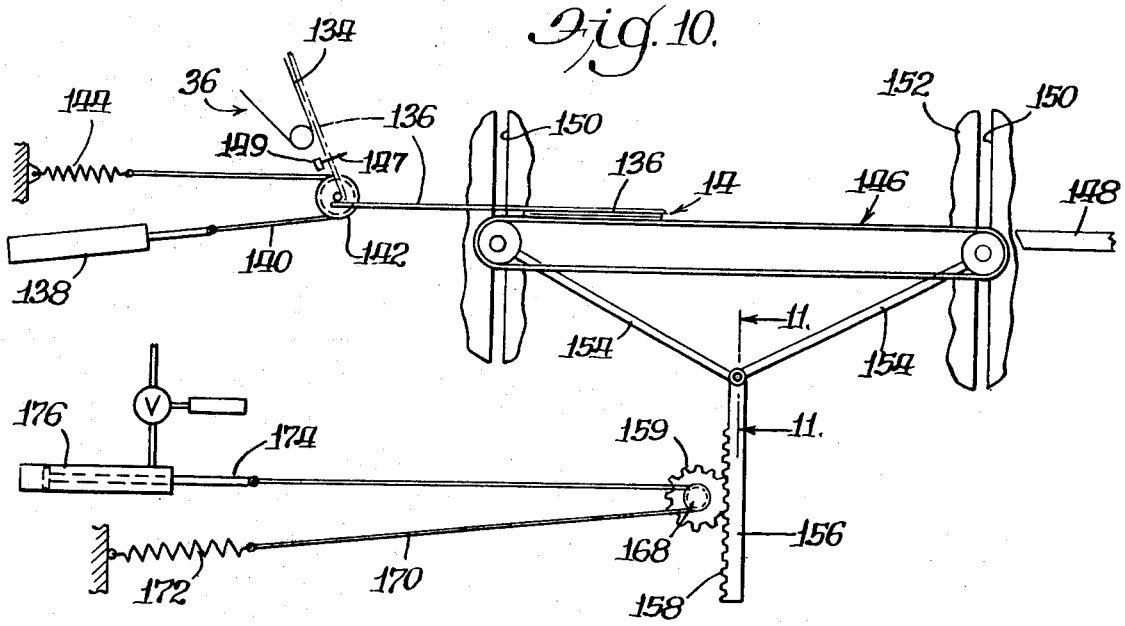
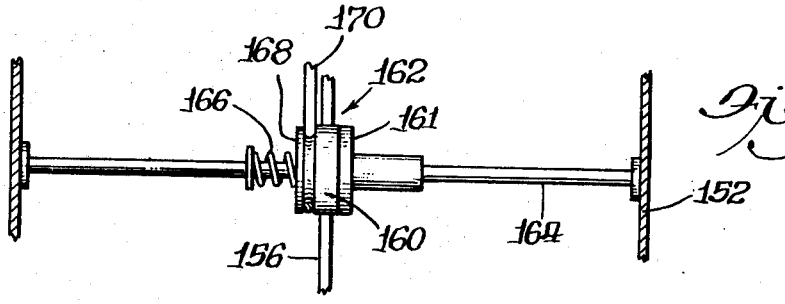
Fig. 11.
Fig. 13.
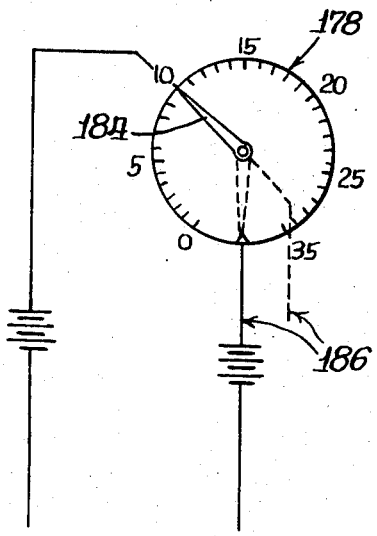
Fig. 12.
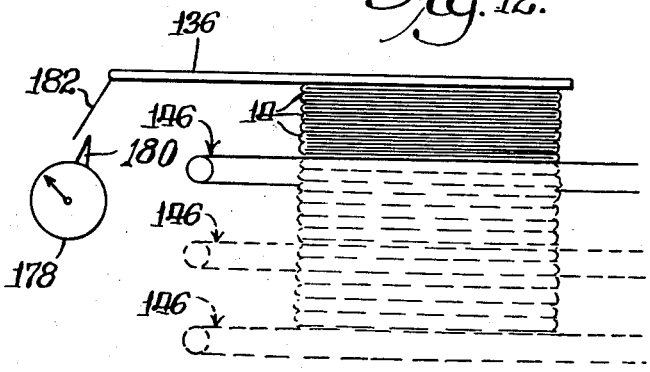

LAUNDRY FOLDER

CROSS-REFERENCE TO RELATED APPLICATION

This application is a division of co-pending application Ser. No. 47,188 of Frederick W. Grantham for LAUNDRY FOLDER, filed June 18, 1970, now U.S. Pat. No. 3,920,237.

OBJECTS OF THE INVENTION

A broad object of the invention is to provide in a laundry folder in which pieces to be folded are introduced into the folder and carried therethrough in a folding operation, means for centering the pieces, as they are introduced into the folder, relative to a longitudinal center line, whereby the pieces are folded about a line midway of the lateral edges thereof so as to provide an accurate fold therein.

Another object is to provide a folder of the foregoing character having shifting means for centering the pieces relative to the longitudinal center line by means of a pair of photo-electric cells arranged for sensing an edge of the pieces as they are introduced into the folder and so arranged that normally only one of the cells is covered by the piece, but that if neither of the cells, or both of them, should be covered, which would be caused by the piece being out of the desired centered position, the shifting means would be activated for shifting the piece in the appropriate direction into a centered position.

A still further object is to provide means for centering the pieces of the character just referred to, which includes a conveyor made of a pair of belts, each belt including a plurality of laterally spaced belt elements, with the belt elements of the two belts interspersed, and wherein one belt is longer than the other, and the means for shifting the belt means is operative for shifting the longer of the two belts, and thereby operative for shifting the laundry pieces laterally relative to the center longitudinal line of the folder.

Still another object is to provide a laundry folder having novel construction for accommodating highly stretchable items, such as knitted items, which are normally difficult to fold in straight line and even formations.

Still another object is to provide a folder of the character just referred to, for folding stretchable items and particularly items such as "boxer" shorts having a waistband of greater strength and resiliency than the remainder of the items, and more specifically a construction which includes folding blades for determining the side edges of the folds of the pieces, and in which those blades are adjustable in the progress of the pieces through the folder, so that as the leading edges, which include the waistbands, of the pieces pass by a predetermined folding point, the guide blades are then adjusted to a narrower-spaced position to fold the following portion of the pieces at a lesser nominal width.

Still another object is to provide, in a laundry folder, a supporting table, which may include a conveyor, for receiving the folded pieces after having been folded and in conjunction with means for forming a stack thereon, and including novel construction for lowering the supporting member or conveyor each time a piece is placed thereon in a stack, and in an amount substantially equivalent to the thickness of a piece so stacked, whereby the top piece of a stack always remains at substantially the same height, whereby to form a more accurate stack.

Yet another object is to provide a construction of the character just immediately referred to utilizing a novel clutch means having friction means for normally holding the supporting surface as positioned, but which slips in response to a laundry piece being placed on the supporting surface.

DESCRIPTION OF A PREFERRED EMBODIMENT:

In the drawings:

FIG. 10 is a side view of certain of the elements at the exit end of the folder, relating to the means for controlling the platform on which the folded pieces are placed;

FIG. 11 is a large scale sectional view taken at line 11—11 of FIG. 10;

FIG. 12 is a side view of the conveyor at the exit end of the folder receiving the folded pieces, together with the wicket for stacking the pieces, and showing diagrammatically different positions of that conveyor; and FIG. 13 shows a counter dial and electrical conductors connected thereto, which are included in a control circuit for controlling the operation of the folder.

Figure 1:
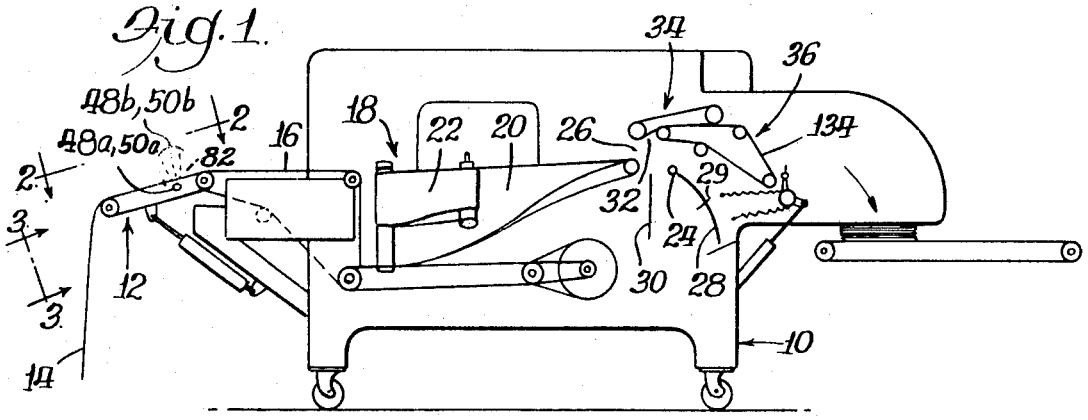
FIG. 1 is a side view, partially diagrammatic in nature, of a laundry folder embodying the features of the present invention.

Reference is now made to the details of the accompanying drawings, wherein FIG. 1 shows the overall construction of a laundry folder of the character to which the present invention is particularly adapted. The folder in its general construction may be similar to that shown in my prior U.S. Pat. No. 3,462,138, dated Aug. 19, 1969, to which attention is directed for detail construction, but, in the present instance, the folder need not include the upper french fold construction included in that patent. The folder includes a frame 10 having a feedboard 12 onto which the laundry pieces 14 are to be folded or placed, and from which the pieces are delivered onto a vertical-folding conveyor belt 16, and from that conveyor belt the pieces are delivered to a conveyor means 18 which includes a twist belt 20 and a training belt or folding belt 22, together taking the vertically folded piece from the conveyor means 16 and delivering it at its delivery end (the right hand end of FIG. 1) in a horizontal position. As the piece thus folded is so delivered, it rides over a roller 24 forming a gap 26 with the main belt 20 and the piece then rides down a curved apron 28 where it engages control means 29 for actuating a folding knife 30 which engages the piece at an intermediate portion and delivers it into a bight 32 between a pair of conveyors 34, 36. The conveyor 34 includes an endless belt trained on a pair of rollers, and the conveyor 36 also is an endless belt trained on rollers, but which will be described more in detail hereinbelow.

One of the principal features of the invention is that the pieces to be folded will be folded accurately relative to a longitudinal center line, and to that end means is provided for centering the pieces on the feedboard 12. The feedboard 12 (FIG. 2) includes an upper roller 38 and lower rollers 40, 42, and a conveyor or belt means 44. The belt means 44 is made up of a plurality of laterally spaced belt elements including a first group **44*a* and another group 44*b* alternately arranged, the elements 44*a* being trained on the rollers 38, 40 while the other elements 44*b* are trained on the rollers 38, 42, and thus being longer than the elements 44*a***.

Figure 2:
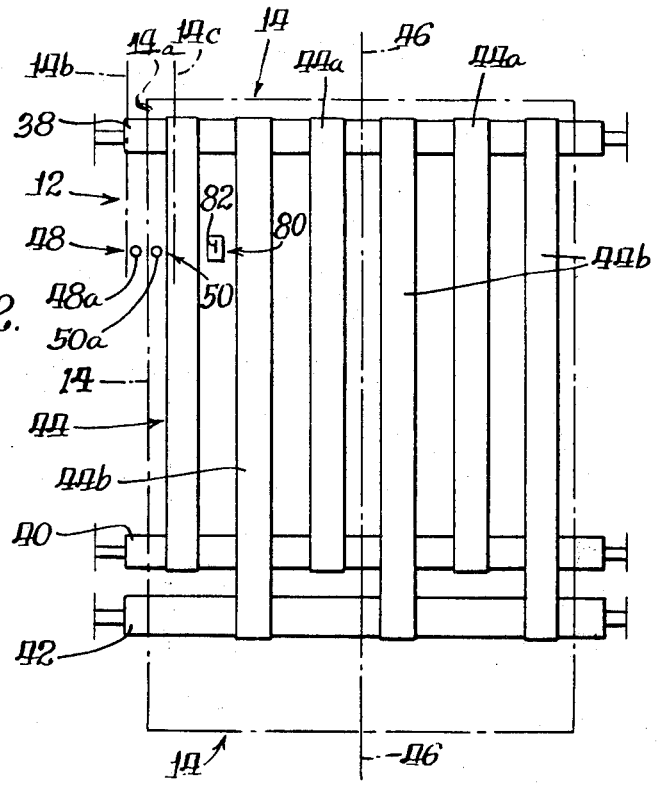
FIG. 2 is a view taken at line 2—2 of FIG. 1.

FIG. 2 shows a laundry piece 14 placed on the feedboard in a laterally centered position as is desired, relative to a longitudinal center line 46, but if the piece should be placed in a position not accurately positioned centrally, but displaced in either direction from a central position, means is provided for centering the piece so as to fold it at the center and thus provide an accurate fold.

This centering means includes a pair of PE (photoelectric) cells 48, 50, shown in FIGS. 1 and 2, the bulbs thereof **48*a*, 50*a* being shown in both figures, and the reflectors 48*b*, 50*b* being also shown in FIG. 1. The PE cells are arranged relative to the feedboard that the laundry piece on being placed on the feedboard in the desired position and traveling therealong, passes with its edge (here the left edge) as indicated at 14*a* between the bulbs and shuts off the one, but not the other PE cell, but if it should be positioned to the left as indicated at 14*b*, or to the right as indicated at 14*c***, the means for shifting the pieces comes into play, as described below.

Figure 3:
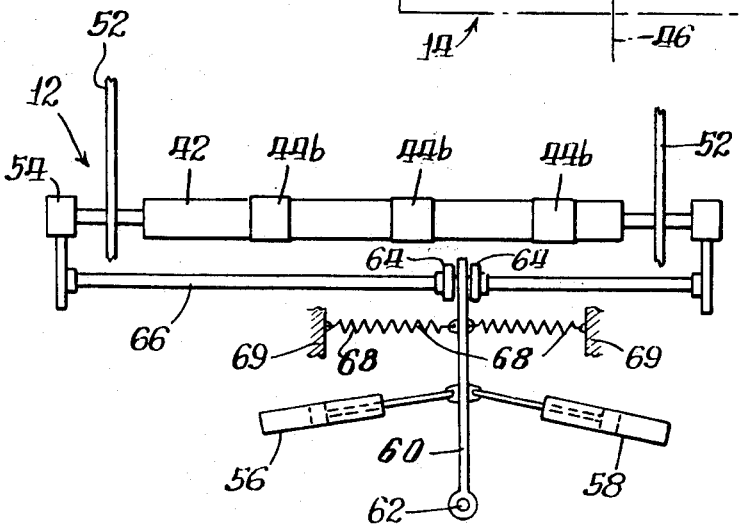
FIG. 3 is a large scale detail view of certain elements of the folder as viewed at line 3—3 of FIG. 1.

Attention is directed next to FIG. 3 which is an end view of the feedboard 12. The lower roller 42 of the feedboard is mounted for axial shifting movement in its support which may be the side plates 52 of the folder in suitable bearing means 54. A pair of cylinders 56, 58 are provided for so shifting the roller 42, these cylinders having pistons connected with a lever 60 pivoted at 62 and having its extended end positioned between a pair of elements 64 on a rod or other kind of element 66 connected with the ends of the roller 42. A pair of counteracting tension springs 68 are connected oppositely to the lever 60 and respectively to fixed elements 69 of the folder. The arrangement of the construction just immediately described, results in shifting of the roller 42 upon actuation of the cylinders 56, 58 in respective directions; i.e., upon actuation of the cylinder 56 the roller 42 is shifted to the left (FIGS. 2, 3) and upon actuation of the cylinder 58 the roller is shifted in the other direction. This shifting movement of the roller 42 results in corresponding shifting of the laundry piece 14 thereon and positioning it relative to the longitudinal center line 46 as referred to generally above. The actuation of the cylinders 56, 58, is controlled by the circuit of FIG. 4 which includes the PE cells 48, 50 and the operation of the control means is controlled according to whether the laundry piece passes over one or both or neither of the PE cells.

Figure 4:
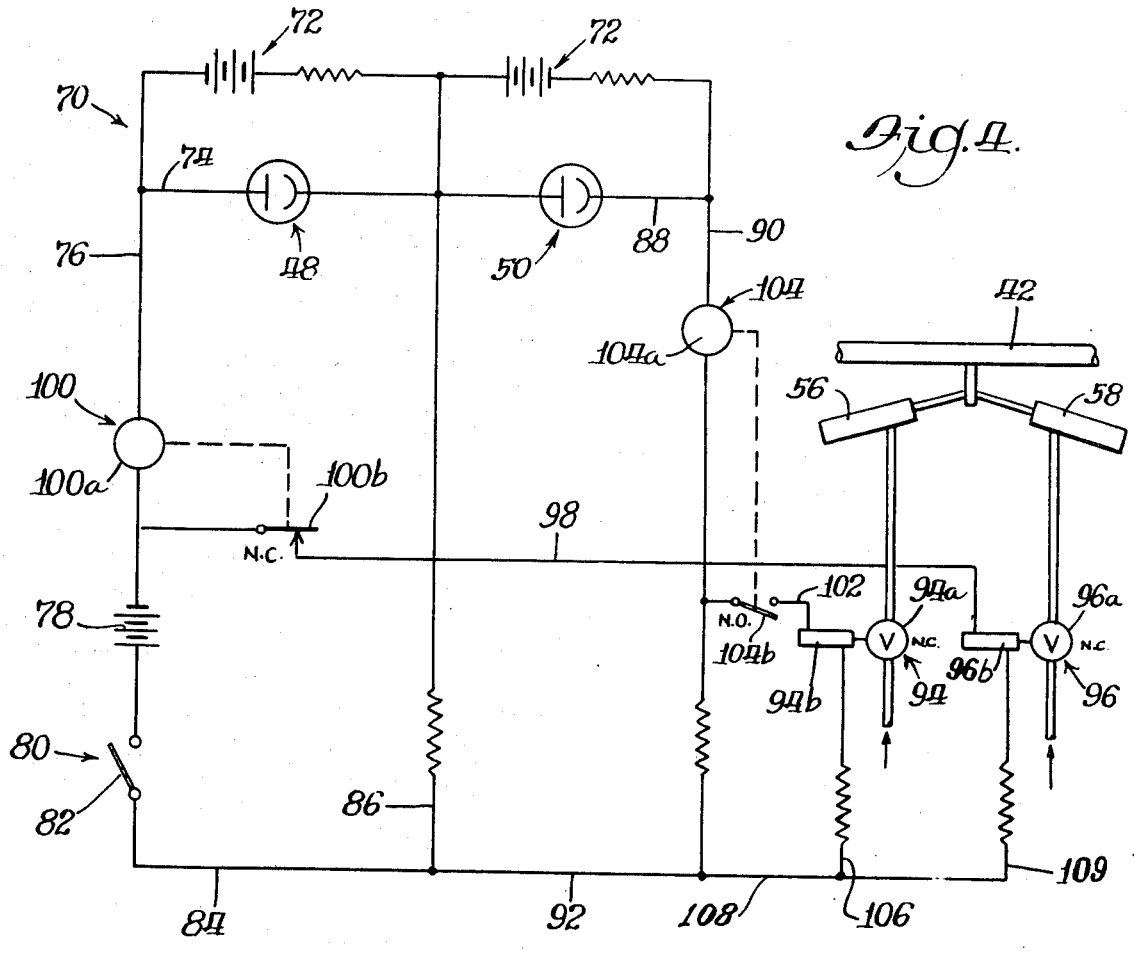
FIG. 4 is a diagram of the electrical circuit utilized in controlling the centering of the laundry pieces in the feeding thereof, together with certain of the mechanics of the folder.
Figure 5:
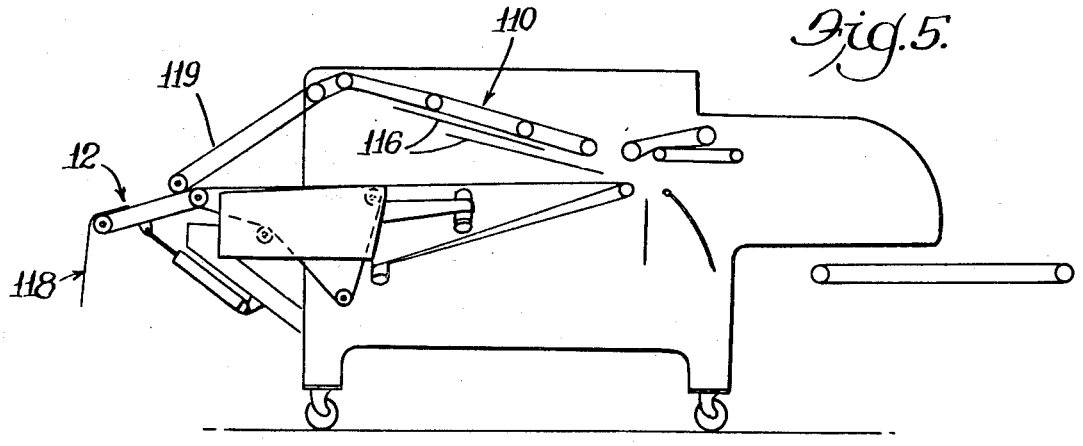
FIG. 5 is a side view similar to FIG. 1, and including a french fold means, to which a second principal feature of the invention is particularly adapted.
Figure 6:
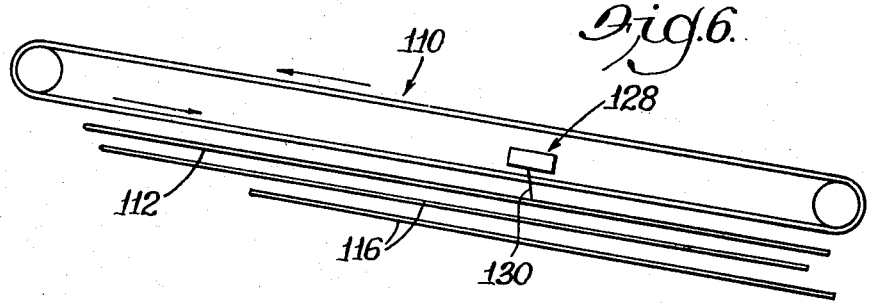
FIG. 6 is a side view of the french folding component isolated from the remainder of the construction.

Referring specifically to FIG. 4, the circuit indicated in its entirety at 70 includes voltage sources 72 respectively connected with the PE cells. The PE cell 48 is connected in a conductor 74 which leads to a conductor 76 and to a voltage source 78 and also which includes a main control switch 80 which is mounted adjacent the feedboard (FIG. 2) and has a finger 82 (FIG. 1) extending above the feedboard for actuation by the pieces to be folded as they move over the feedboard. The conductor 76 leads to another conductor 84 which in turn leads to a conductor 86 and the latter connects with the conductor 74 completing a circuit through the PE cell 48.

The PE cell 50 is incorporated in a conductor 88 which connects on one side with the conductor 86 and on the other side with the conductor 90 and the latter connects with another conductor 92 completing a circuit through the voltage source 78 with the PE cell 50.

The switch 80 is so incorporated in the circuit of FIG. 4 that if it is open no control movements are effected, but when it is closed, the control movements are produced according to the positions of the pieces to be folded. In other words so long as there is no laundry piece moving over the feedboard, the complete circuit remains open, and it is only when a laundry piece moves over the feedboard and engages the switch finger 82 that the circuit is energized and controlled to produce the adjusting effect desired. The switch 80 is positioned longitudinally of the feedboard relative to the PE cells 48, 50, and as a practical matter positioned slightly beyond those cells, so that the control of the circuit is produced under the control of those PE cells only when a laundry piece reaches that position which is preferably where the leading edge of the piece to be folded is actually beyond, although only slightly beyond, those PE cells.

FIG. 4 shows valve means 94, 96 for controlling the respective air cylinders 56, 58, these valve means including valves proper **94*a*, 96*a* and electromagnets 94*b*, 96*b* for actuating the valves. The valves are normally closed, and upon energization of the electromagnets the valves are opened and the corresponding air cylinders 56, 58 are energized resulting in corresponding shifting of the roller 42** as referred to above.

A conductor 98 leads from the conductor 76 to the electromagnet **96*b*, and a relay 100 has a coil 100*a* in the conductor 76 and a normally closed switch 100*b* in the conductor 98**.

A conductor 102 interconnects the conductor 90 and the electromagnet **94*b*, and a relay 104 includes a coil 104*a* in the conductor 90 and a normally open switch 104*b* in the conductor 102. Circuit through the electromagnets includes a conductor 106 leading from the electromagnet 94*b* and connecting with a conductor 108 which in turn connects with the conductor 92; and another conductor 109 leading from the electromagnet 96*b* and connecting with the conductor 108**.

Referring to the operation of feeding the laundry pieces into the folder, the operator upon acquiring the desired skill places each piece as indicated in FIG. 2 in which it works up the feedboard and its left edge **14*a* is disposed between the PE cells 48, 50, i.e., it covers the PE cell 50 but leaves the other PE cell 48 open; this being the desired position, there is no action occurring in the control in the machine with respect to centering the laundry piece. In such a situation, with the right PE cell 50 interrupted, and the left PE cell 48 open, and referring to FIG. 4, — a circuit exists through the PE cell 48, energizing the relay 100 and holding the switch 100*b* open. Accordingly the electromagnet 96*b* is deenergized and the valve 96*a* remains closed. At the same time the subcircuit including the PE cell 50 is open, de-energizing the relay 104, and leaving the switch 104*b* open, and in this case also the electromagnet 94*b* is de-energized and the valve 94*a*** is closed.

Assuming in a first instance that the laundry piece is accidentally placed off center and in one case, too far to the right as indicated at **14*c* where the left edge is beyond the PE cell 50 and in which both PE cells are exposed. In this case, and referring to FIG. 4, the PE cell 50 being non-interrupted, a circuit is completed through that cell, conductors 88, 90, 92, 84, 76 and 74, in return to the cell. The relay 104 is thereby energized, closing the switch 104*b* and energizing the air cylinder 56. This cylinder then contracts and shifts the roller 42 to the left, and as represented in FIG. 2, the belt elements 44*b* at their lower ends are accordingly shifted, which shifts them to the left, and the laundry piece accordingly. This movement is precalculated in extent to move the laundry piece the desired amount so as to cover the PE cell 50, thereby de-energizing the valve means 94. The laundry piece is then centered relative to the longitudinal center line 46**, and it progresses through the folder in that same orientation.

Assuming in another instance that the operator accidentally places the laundry piece too far to the left as indicated at **14*b*, where in its passage over the feedboard it covers both PE cells, and particularly the PE cell 48. In this case the circuit condition which before enabled the valve means 94 to remain de-energized is altered so that the PE cell 48 is interrupted, the relay 100 is de-energized, enabling the switch 100*b* to close, which closes a circuit through the electromagnet 96*b* of the valve means 96 and admits air to the cylinder 58 and contracts that cylinder and shifts the roller 42 to the right which carries the laundry piece to the right to its properly centered position. This movement uncovers the PE cell 48, and the electromagnet 96*b* of the valve means 96 becomes de-energized and the air cylinder 58** becomes correspondingly de-energized.

In each of the above cases, whether the laundry piece was placed too far to the right, or too far to the left, when it is returned to the desired central position, it continues through the folder in such central position, symmetrical relative to the center line 46, and an accurate fold is performed in the piece.

In any case, whether an adjustment is made to the left or to the right, after the respective air cylinder 56 or 58 is de-energized, the roller 42 is centered by the counteracting tension springs 68 so that after a laundry piece has passed through the machine, the roller 42 is in position to receive the next piece in center position and if it is in the desired center position no control activity is exercised.

The PE cells 48, 50 may be spaced apart laterally according to the desired latitude; one convenient spacing is two inches, in a situation where a maximum of nearly 2 inches variation is permissible. For example in the case of a large towel if it were off center by nearly an inch, that would be acceptable, but if it should be off center more than that the centering control operation would come into play and bring the towel back to its desired position. The distance between the PE cells 48, 50 is of course as desired and in the case of larger pieces the spacing may be greater than the case of smaller pieces, being within the compass of the invention to provide means for adjusting that spacing to provide different ranges for different kinds of laundry pieces.

Attention is next directed to another phase of the invention which has to do with providing a fold in laundry pieces in which the different portions of those pieces are of different stretchability or yieldability. Attention is directed to the kind of garment known as "boxer" shorts which include a waistband of greater retractable strength. In the folding of this type of garment, that greater strength heretofore has interfered with the folding of other portions of the garment whereby an undesirable shape of the final folded piece resulted. The present invention includes means for stretching that waistband, in the folding operation, so that it assumes a final folded dimension similar to or commensurate with the final folded dimension of the remaining portions of the garment.

Referring to FIGS. 5-9, the folder includes french fold means identified generally at 110 including a pair of main folding blades 112 mounted for relative lateral movement toward and away from each other by suitable means indicated diagrammatically at 114. Under the folding blades 112 are forming blades 116, which together with the folding blades 112 form a french folding means of known construction.

Figure 7:
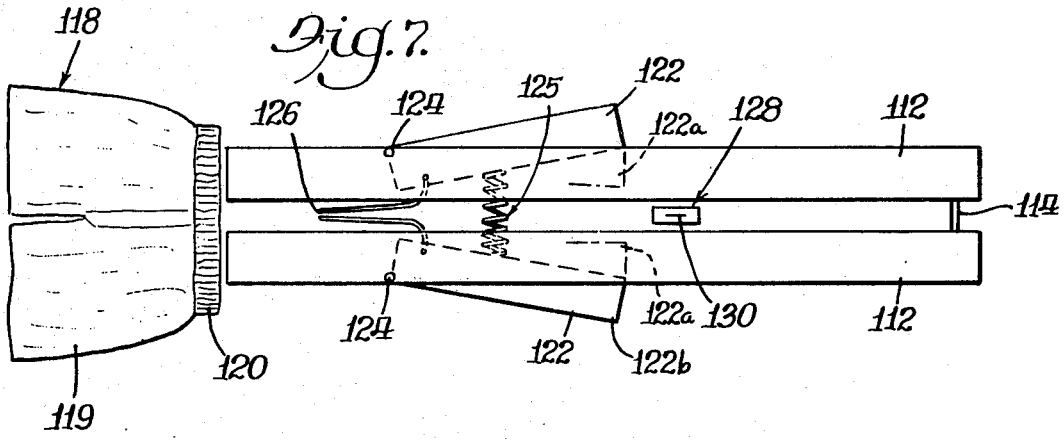
FIG. 7 is a top view of the component of FIG. 5 together with a piece to be folded of the kind known as "boxer shorts"

FIG. 7 shows a laundry piece 118 known as "boxer" shorts which the present invention is particularly adapted for folding because of the peculiar characteristics encountered in that piece. The boxer shorts 118 include a waistband 120 of resilient characteristics, but of relatively great strength, and of a strength substantially greater than the body or butt portion 119 of the piece, and while the body piece may be either stretchable or not stretchable, the consideration is that the waistband is substantially stronger than the body portion whereby when it does stretch and is enabled to retract, it tends to assume a dimension substantially smaller than the body portion. It is in connection with this phenomenon that the presently involved feature of the invention is concerned.

Figure 8:
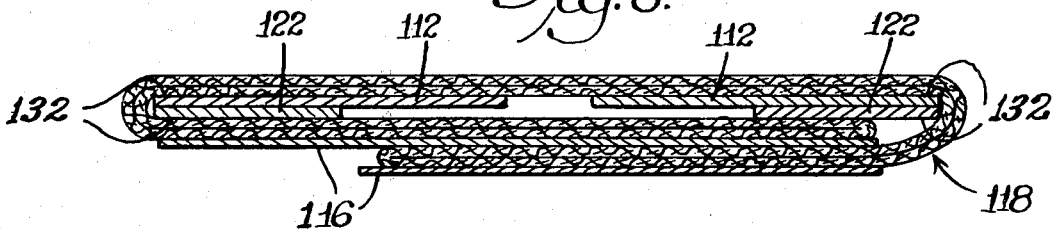
FIG. 8 is a large scale sectional view taken at line 8—8 of FIG. 9*c;*
Figure 9:
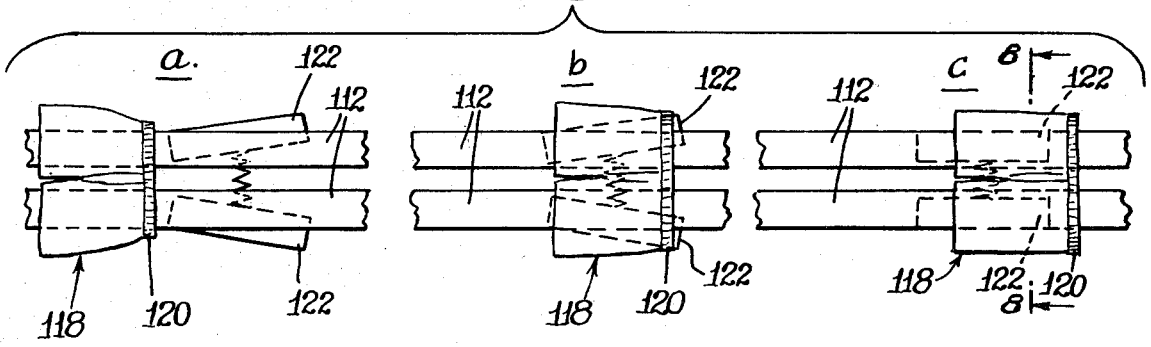
FIG. 9 is a diagrammatic illustration, oriented according to FIG. 7, showing several stages in the folding of the laundry piece.

FIGS. 7–9 show auxiliary blades 122 mounted on respective ones of the main folding blades 112 and pivoted at axes 124 thereon, these axes being at an end of the blades 122 and their free ends are swingable about those axes in planes parallel to the planes of the blades 112, between an inner position **122*a* in which the outer edges of the auxiliary blades are substantially coincident with the outer edges of the folding blades 112 and an outer position 122*b* in which the outer edges of those auxiliary blades extend laterally beyond the edges of the folding blades 112**.

In the operation of the french folding construction, the piece 118 to be folded is fed through the folder (FIG. 5) as on the feedboard 12 and it rides up the conveyor 119 into the french fold component where it rides on the folding blades 112, between the blades 112 and the underside of the conveyor of folder 110, and the side flaps of the piece lap over the folding blades and move under the forming blades 116 in a known manner. The operation of such french folding means is of course known. Although not shown for simplicity, it will be understood that the folding blades 112 are supported from the left end and extend to the right in cantilever fashion, as is customary in french folding apparatus, the pieces to be folded sliding on the blades 112 as propelled by the adjacent conveyor belt with the outboard edges of the piece hanging down for engagement by the forming blades 116.

In the normal operation of folding laundry pieces in a french fold, they hug the folding blades 112, determining the maximum width of the final folded piece, in certain cases, but in the present instance where the waistband 120 is of greater strength and consequent greater retractile characteristics, any width of the folded piece as determined by the folding blades 112, in a normal operation, would result in that same width being provided in the waistband 120, while the waistband were on the folding blades 112, but after it rode off the folding blades it would contract to a smaller dimension and be smaller than the remainder, or body portion, of the piece being folded.

To counteract that situation, the auxiliary blades 122 are provided. These are controlled by suitable means indicated diagrammatically at 126 which is operative for spreading and contracting those blades about their axes 124, which is under the control of a switch 128 having a finger 130 extending above the folding blades 112 (FIG. 6) for engagement by the laundry piece as it moves over the main folding blades 112. The operation is such that the blades 122 normally assume their outer diverging position and upon the laundry piece contacting the switch 128, they are moved into their inner position.

In the folding operation, the forming blades 116 are positioned sufficiently close to the folding blades 112 that they hold the side flaps of the laundry piece tight against each other and against the top portion of the laundry piece (See FIG. 8) so that in the final folded piece, the piece holds its shape as thus formed. Previously when the strong waistband was folded in the same dimensions as the remainder of the piece the waistband contracted to a much smaller dimension than the remainder, but because of the auxiliary blades 122, this difficulty has been overcome.

The auxiliary blades 122 are biased apart by compression springs 125, to their outer position shown in full lines in FIG. 7. As the laundry piece 118 moves past the auxiliary blades 122, the central portion of the piece 118 sliding on top of the main folding blades 112 with the outer portions hanging down and being folded underneath the main blades 112 by the forming blades 116 in the manner shown in FIG. 8, it engages the switch finger 130 which operates a control means for actuating the means 126 for drawing the auxiliary blades 122 inwardly to their dotted line position in which their outer edges are coincident with the outer edges of the main folding blades.

In the progress of the laundry piece 118 through the french folding device 110, the waistband 120 rides over the diverging edges of the auxiliary blades and these blades expand the waistband accordingly. The switch 128 is positioned longitudinally of the main folding blades 112 at such position that when the leading edge of the laundry piece engages it just beyond the auxiliary blades, and immediately after the full waistband leaves the auxiliary blades 122, those blades are immediately and abruptly withdrawn into their inner position. The body portion of the laundry piece then is enabled to hug the main folding blades 112 and they are folded into a transverse dimension as determined by the outer edges of the main folding blades.

As the laundry piece moves along the french folding component means, the side flaps are engaged between the forming blades 116 and the surfaces thereabove in a tight fitting arrangement, whereby they are frictionally held against withdrawal sideways and they thereby prevent the side flaps from being drawn out and relieving the positioning of the upper portion of the laundry piece as folded as described above. The friction between the outer edges of the main folding blades 112 and auxiliary blades 122 with the piece being folded, as indicated at points 132 (FIG. 8), further resists withdrawal or pulling out of the side flaps as folded under the folding blades.

FIG. 9 represents diagrammatically and semi-schematically, different positions in progress of the laundry piece as it is being folded, in its progress through the folder. In FIG. 9*a* the laundry piece 118 is approaching the auxiliary folding blades 122, being positioned at their divergent inner ends. As the laundry piece passes along the french folder component, the waistband 120 moves over the auxiliary blades 122 and thereby is increased in transverse width to a position represented in FIG. 9*b* and it is to be noted that the body portion of the laundry piece tends to incline inwardly more toward the dimension of the main folding blades 112. In FIG. 9*c* the waistband 120 has just passed beyond the auxiliary blades 122, and the latter have been retracted into their inner position, but the waistband has been expanded to an outer position beyond which it would assume if the auxiliary blades were not utilized. Accordingly, the waistband 120 and the body portion of the laundry piece assume a configuration in which the side edges extend generally parallel, whereby to provide a folded article which is generally rectangular, as contrasted with a trapezoidal configuration which usually resulted heretofore.

Although the waistband after it has left the folding blades, will contract, due to its resilience, it will contract throughout its length, i.e., its transverse length or circumferential length, though doubled or folded, but any such contraction will be distributed throughout the entire length of the band and the original spacing of those portions as determined by the outermost divergent ends of the auxiliary blades will determine the transverse spacing of the waistband in its folded condition and any contraction resulting in the waistband will not be continuous or cumulative throughout the linear progression of the waistband, but in transverse dimension of the folded article as determined by the transverse spacing of the outer divergent ends of the auxiliary blades 122. Accordingly any contraction of the waistband will be commensurate with the ultimate transverse dimensions of the body portion of the laundry piece with the result that the final folded piece will be substantially rectangular in shape.

Attention is next directed to FIGS. 10 to 13 illustrating another important feature of the invention.

When the laundry pieces upon being folded by the knife 30 FIG. 1) are forced up into and between the conveyors 34, 36, they ride between the latter conveyors and down over the final portion 134 of the conveyor 36, which is inclined sharply to the vertical. Associated with the conveyor 36 is a wicket 136 in an arrangement similar to the construction disclosed and claimed in the co-pending application of the present Grantham and Edward L. McClain Ser. No. 45,188, filed June 10, 1970, now U.S. Pat. No. 3,684,274, the folded pieces 14 ride down over the conveyor portion 134 and over the wicket 136. The wicket 136 is movable between a retracted position shown in dot-dash lines in FIG. 10, and a forward advanced position shown in full lines in FIG. 10 by means of an air cylinder 138 working through a chain or flexible element 140 trained on a pulley 142 on the shaft of the wicket 136. Upon actuation of that air cylinder the wicket is thrown from its retracted position to its advanced position, and upon de-energization of that air cylinder, the wicket is retracted by a tension spring 144 also acting through the flexible element 140.

When the folded piece rides down over the final portion 134 of the conveyor 36, and upon engaging a control element such as the finger 147 of a switch 149, control means is actuated for energizing the air cylinder 138 and swinging the wicket down, and the folded piece 14 that is on the wicket at that time is thrown down onto a supporting surface or platform 146 which preferably is in the form of a conveyor for receiving the pieces, preferably in a stack, and after the stack reaches a certain number, e.g. 10, the conveyor is moved for conveying the stack onto a table or other surface 148. The conveyor 146 and its operation are of known type.

The conveyor 146 is mounted for vertical movement as controlled by guide elements 150 which may be in the form of slots receiving end elements in the rollers of the conveyor. These slots may be formed in the sidewalls 152 (FIG. 10) of the folder.

Connected to the conveyor and preferably to the rollers at the ends thereof is suitable means 154 which may be in the form of rods or bars interconnected with a member 156 having a rack 158 with which a pinion 159 meshes. The pinion is secured to a disc 160 which with another disc 161 have high-friction interengaging surfaces forming a friction clutch 162. The clutch 162 is mounted on a bar 164 in turn mounted on the side walls 152 of the folder and held against movement both axially and rotationally. The disc 160 is movable both rotationally and axially on the rod and biased into high friction engagement with the disc 161 by means of a compression spring 166. The movable disc 160 is provided with a pulley 168 trained over which is a chain or flexible element 170 secured at one end to a tension spring 172 and at the other end to the piston 174 of an air cylinder 176.

The friction between the discs 160, 161 is sufficient to hold the conveyor 146 at any given position, but the disc 160 will slip relative to the other, upon sufficient pressure being imposed on the conveyor to lower it. Such pressure is provided by the moving or slamming down of the wicket 136 in placing the folded pieces 14 on the conveyor, this action resulting in the downward movement of the conveyor at each actuation of the wicket, an amount or increment substantially equal to the vertical thickness of the folded piece, with the result that the top piece of a stack is always at substantially the same height, i.e., assuming a given uppermost position of the conveyor 146, when the first piece 14 is placed on the conveyor it assumes a given position, at a certain height, and when the next piece is placed down, the pressure of the wicket forces the conveyor down an amount caused by the action of the wicket acting through the piece then being placed, and in consequence the conveyor is moved down an amount substantially equal to the thickness of the folded piece. The pieces are continuously placed down in the stack and FIG. 12 indicates different phases or stages of the stacking operation, where the conveyor 146 is shown at different positions in the stacking operation.

A counter is indicated in its entirety at 178 which is of known kind, having a triggering finger 180 actuated by another finger 182 on the wicket. The counter 178 has the usual indicator which may be a hand 184 and the counter is arranged in an electric circuit 186 in such a way that when the desired number of pieces to be stacked is reached, such as 10, 15, etc., the circuit is energized and a control function performed for actuating an associated air cylinder (not shown) which drives the conveyor 146 for carrying the stack then formed out of stacking position (to the right, FIGS. 10, 12) and energizing the air cylinder 176 to contract the cylinder, rotating the pulley 168 in retracting direction (counterclockwise, FIG. 10) and raising the conveyor 146 to its uppermost position for receiving again the first pieces of the new stack and then lowering as that stack is formed. The clutch means 162 is effective for holding the conveyor means 146 at any position, as indicated above, and the action of the air cylinder 176 is effective for moving the disc 160 against the friction holding it by the associated disc 161.

I claim:

1. In a laundry folder including conveyor means for receiving laundry pieces at an entrance end and carrying them through the folder and folding them and placing them on a supporting means at an exit end, and in which the conveyor means includes a feedboard at the entrance end on which the laundry pieces are placed, the feedboard including a belt member means forming a segment of the conveyor means, the conveyor means being so positioned and arranged for most effectively conveying the laundry pieces when they are placed on the feedboard in a transversely central position, the combination comprising:

means responsive to the position of a laundry piece on the feedboard out of its said transversely central position for shifting it into its said transversely central position, whereby the piece then is conveyed in such position by the conveyor means through the folder, folding means including a french folder which includes a pair of main folding blades and a pair of auxiliary folding blades associated therewith, each pair having outside and inside edges, the main folding blades extending longitudinally and being spaced apart laterally, the pair of auxiliary folding blades being mounted on the main folding blades and extending generally longitudinally and pivoted for movement between an inner position in which their outer edges are coincident with the outer edges of the main folding blades and an outer position in which their outer edges diverge in direction along the line of progress of the pieces being folded, means for moving the auxiliary blades between their inner and outer positions, and means controlled by the movement of the piece being folded along the main folding blades for actuating the means for moving the auxiliary folding blades to their inner position at a predetermined point in the progress of the piece being folded along the french folding means whereby a portion of the piece is spread widely and the remainder of the piece is spread less widely, means for stacking folded pieces including a final supporting surface at the exit end of the folder, a wicket for receiving the pieces conveyed through the folder and movable for placing the pieces on a supporting surface, the supporting surface being vertically movable, clutch means for supporting the supporting surface normally in a fixed position but yieldable in response to predetermined pressure applied to the supporting surface for enabling it to be lowered by an extent in proportion to the pressure so applied, and operative for maintaining the supporting surface at each new position as thus moved, means for raising the supporting surface, and means responsive to the pieces being stacked to a predetermined extent on the supporting surface for actuating the means for raising the supporting surface.

2. In a laundry folder having an entrance end and an exit end, conveyor means adapted for receiving, at the entrance end, laundry pieces to be folded and for conveying them through the folder and delivering them from the exit end, and means for folding the pieces in their progress through the folder, comprising a feedboard forming a segment of the conveyor means for directly receiving the pieces, sensing means at the feedboard responsive to the presence of laundry pieces on the feedboard over the sensing means, the sensing means including spaced sensing elements positioned laterally with respect to the conveyance path of the laundry pieces and adapted to be covered by a piece which is displaced laterally in one direction from a transversely central position and not covered by a piece which is displaced laterally in the opposite direction from the central position, and control means responsive to the presence of a piece over either both or none of the sensing elements for energizing the control means for moving the piece from either laterally displaced position to the transversely central position.

3. The invention according to claim 2 wherein the transversely central position of a piece is with a lateral edge between the sensing elements, and wherein in that position of the piece the control means is inactive.

4. The invention according to claim 3 wherein the control means includes means responsive to both of the sensing elements being uncovered for moving the piece transversely in a direction to cover only one of the sensing elements.

5. The invention according to claim 3 wherein the control means includes means responsive to both of the sensing elements being covered by the piece for moving the piece in a direction to cover only one of the sensing elements.

6. The invention according to claim 3 wherein the sensing elements include first and second PE cells spaced apart transversely, the first cell adapted to be covered by the piece when it is disposed centrally relative to a central longitudinal line with an edge located between the PE cells, and wherein the control means comprises a control circuit including the PE cells, the circuit including a pair of control circuit portions, one responsive to the first PE cell covered by the laundry piece in its central position which is inactive when so covered, and another control circuit portion responsive to the second PE cell, and inactive when not covered by the laundry piece, and whereby the two control circuit portions, in response to a piece which is centered, render the control means inactive for laterally displacing the laundry piece.

7. The invention according to claim 3 wherein the means for shifting the laundry piece from a laterally displaced position into the central position includes a conveyor belt made up of a plurality of laterally spaced belt elements, certain of the belt elements being fixed laterally and other belt elements being shiftable laterally, and means for shifting the shiftable belt elements.

8. The invention according to claim 7 wherein the belt elements include two groups incorporated in a feedboard and also include two lead-in rollers, the belt elements of one of the groups being trained on and controlled by one of the rollers, and the belt elements of the other group being trained on and controlled by the second roller, the second roller being shiftable laterally and thereby operative for shifting the second group of belt elements, the second group of belt elements extending longitudinally at least as far as the second group of belt elements, whereby upon laterally shifting of the second roller and thereby the second group of belt elements, the piece on the feedboard is shifted correspondingly relative to the feedboard as a whole.

9. The invention according to claim 8 wherein the means for shifting the shiftable roller includes a pair of air cylinders operatively connected with the shiftable roller and operative for shifting that roller in corresponding transverse direction, and control valve means operatively arranged for leaving the air cylinders in inactive position in normal operation, and when activated, opening air lines to the cylinders for enabling actuation of the cylinders, and the control means is operative when the respective PE cells are exposed or covered, respectively, for controlling the valve means and correspondingly effecting actuation of the air cylinders for thereby in turn correspondingly shifting the shiftable roller.

10. A laundry folder having an entrance end and an exit end, conveyor means adapted for receiving, at the entrance end, laundry pieces to be folded, and conveying them through the folder and delivering them from the exit end, and means for folding the pieces in their progress through the folder, comprising a feedboard at the entrance end including a conveyor component forming a segment of the conveyor means, the feedboard being adapted for receiving the pieces in a transversely central position, first and second PE cells at the feedboard and spaced laterally on opposite sides of a longitudinal line in register with a lateral edge of the laundry piece when it is in the transversely central position, and whereby when the laundry piece is so positioned, it covers the first of the PE cells but not the second PE cell, the conveyor means in the feedboard including a pair of belt members, each member including a plurality of transversely spaced elements, the feedboard also including first and second transverse lead-in rollers spaced longitudinally apart, the belt elements of one member being trained on the first of those rollers, and the belt elements of the other member being trained on the second of those rollers, and the first roller being transversely movable relative to said second roller whereby to shift the belt elements trained thereon to the other belt elements, thereby being operative for shifting the laundry piece laterally on the feedboard as a whole, means for shifting the first roller including a pair of air cylinders oppositely arranged and each operative for shifting the first roller in a corresponding lateral direction, circuit means controlled by the PE cells for controlling the air cylinders and thereby the shifting of the first roller including a first portion rendered inactive when the laundry piece is thereover, and operative when exposed, when the laundry piece is shifted away from both of the PE cells, for controlling the respective circuit portion for in turn controlling the air cylinder for shifting the first roller for thereby shifting the laundry piece back into its central position whereby it covers that first PE cell, the circuit including a second portion controlled by the second PE cell rendered inactive when that cell is exposed, but rendered active when it is covered as a laundry piece is shifted thereover, whereby the second circuit portion controls the corresponding air cylinder for shifting the first roller in corresponding direction for shifting the laundry to its said central position in which the second PE cell is exposed.

11. A laundry folder having an entrance end and an exit end and conveyor means for receiving a piece to be folded and conveying it through the folder and including means for folding the piece in its progress through the folder, comprising a supporting member for receiving the folded pieces as delivered through the exit end, the folder also including wicket means for receiving the folded pieces and placing them on the supporting member, the wicket means including a transverse shaft and a plurality of rods movable between a retracted position adjacent the conveyor means in which the folded laundry pieces are placed thereon and an advanced position in which it is generally horizontal and operative for placing the laundry piece on a supporting member top surface, and a friction clutch normally holding the supporting surface in an elevated starting position and enabling movement thereof downwardly in increments in response to the wicket means operating to stack the laundry pieces onto the supporting surface; and means driving the friction clutch for elevating the supporting surface back to it starting position after the accumulation of a predetermined number of said pieces thereon thereby positioning the stack of laundry pieces for removal from the support member.

12. A laundry folder according to claim 11 wherein the friction clutch is adapted to maintain the support member in a predetermined position, and wherein the wicket means operating to place a laundry piece on the support surface forces the support member downwardly against the action of the clutch.

13. A laundry folder according to claim 12 the driving means including means for raising the support member against the action of the friction clutch, whereby when the support member is thus raised, it is again held in such raised position by the friction clutch.

14. A folder according to claim 13 and including a counter for counting the pieces as placed on the support member, and means controlled by the counter reaching a predetermined position, according to the number of pieces placed on the support member, for energizing the driving means to raise the support member to the elevated starting position.

15. A laundry folder according to claim 24 wherein the support member includes a conveyor, and further comprising a counter for counting the pieces placed on the conveyor, and means responsive to placement of a predetermined number of pieces on the conveyor as determined by the counter, for operating the conveyor for conveying pieces placed thereon by the wicket means away from the wicket means, and for also energizing the driving means to raise the conveyor to the elevated starting position.

16. A laundry folder according to claim 11 wherein the friction clutch means for supporting the supporting surface incorporates the clutch includes a shaft supported in side elements of the folder, a first disc member mounted on the shaft against displacement both rotationally and axiallv, a second disc mounted on a shaft for both rotational and axial displacement, the two discs having high-friction surfaces interengaging and operative for normally maintaining the support surface in a given position, means operative for biasing the second disc axially into friction engagement with the first disc, and further including means interconnecting the support surface with the second disc whereby the second disc maintains the supporting surface in a given position in the absence of excess pressure, the second disc being subject to rotational displacement in response to excessive pressure imposed on the supporting surface which lowers the supporting surface and the clutch being operative for supporting the support surface in such new position pursuant to such movement, the wicket means including a transverse rock shaft, pulley means on the rock shaft, a flexible strand on the pulley means, a tension spring active on the flexible strand operative for moving the wicket means to retractive position, an air cylinder connected with the other end of the flexible strand operative for moving the wicket means for placing a folded piece onto the supporting surface, and means responsive to each folded piece being placed over the wicket means for activating the air cylinder for placing that folded piece on the supporting surface.

* * * * *